United States Patent [19]

Ming et al.

[11] Patent Number: 5,002,124

[45] Date of Patent: Mar. 26, 1991

[54] UNDERGROUND TEMPERATURE AND PRESSURE MEASURING SYSTEM FOR HOT-EXPLOITING OIL WELL

[75] Inventors: Ma Ming; Sun Zhenfang; Liu Li; Li Min; Wang Chunyan, all of Liao Ning, China

[73] Assignee: Research Institute of Drilling & Production Tech., Kiao Ning, China

[21] Appl. No.: 542,155

[22] Filed: Jun. 21, 1990

[51] Int. Cl.[5] ..... E21B 7/04; G01F 1/46; G01L 9/06

[52] U.S. Cl. ..... 166/250; 374/136; 374/143

[58] Field of Search ..... 166/64, 250; 73/37, 73/154; 374/135, 136, 143, 186, 187, 196, 206, 207

[56] References Cited

U.S. PATENT DOCUMENTS

| | | | |
|---|---|---|---|
| 2,750,796 | 6/1956 | Knoll et al. | 374/136 X |
| 3,209,595 | 10/1965 | Harland | 374/143 |
| 4,554,927 | 11/1985 | Fussell | 374/143 X |
| 4,563,902 | 1/1986 | Kohnlechner | 374/143 X |
| 4,765,751 | 8/1988 | Pannone et al. | 374/143 |
| 4,828,051 | 5/1989 | Titchener et al. | 166/250 X |
| 4,933,640 | 6/1990 | Kuckes | 166/250 X |

*Primary Examiner*—Thuy M. Bui

*Attorney, Agent, or Firm*—Kennedy & Kennedy

[57] ABSTRACT

A kind of underground temperature and pressure measuring system for hot-exploiting oil well mainly comprises a casing, a high-temperature sealing element, a high-temperature time-controlling unit, a pressure sensing unit and its recording system and a temperature sensing unit and its recording system, wherein, the high-temperature sealing element is made of flexible graphite, and the pressure sensing element is made of particular material; the temperature sensing unit is connected with the pressure sensing unit by bellows, so that the temperature sensing unit and its recording system can be put around the pressure sensing unit and its recording system, and therefore the present device is not long, but it can be used to measure temperature and pressure of underground steam at different depth simultaneously, which make the calculation of underground thermal conditions possible and reliable.

3 Claims, 4 Drawing Sheets

EXPERIMENTAL AND PREDICTED PRESSURE DROP FOR MICROCHANNELS, TAPERED CHANNELS AND TILTED COVER HEAT EXCHANGERS.

△ STRAIGHT, EXPERIMENT

◇ TILT, EXPERIMENT

○ TAPER, EXPERIMENT

—— STRAIGHT, PREDICTED

—— TILT, PREDICTED

—— TAPER, PREDICTED

UNDERGROUND TEMPERATURE AND PRESSURE MEASURING SYSTEM FOR HOT-EXPLOITING OIL WELL

INTRODUCTION

The present invention relates to a kind of temperature and pressure system, especially a kind of temperature and pressure measuring system which measures temperature and pressure simultaneously and more especially a kind of underground temperature and pressure measuring system for hot-exploiting oil well.

The saturated-steam-injecting method is a new kind of thick oil exploiting technology. To control the velocity of injecting steam and injection time of steam, it is necessary to know underground thermal dynamic conditions in the oil well at any time, so the time-varying temperature and pressure of underground saturated steam must be measured, so as to obtain the value of the temperature and pressure at different depth of oil well, which can be used to calculate other underground thermal parameters and to determine an effective steam injection method. By means of general method, the measuring device must be put into the oil well for two times to measure the temperature and pressure of the underground steam respectively. The interval between two measurement is about 3 to 4 hours, so the measured temperature and pressure are not the simultaneous thermal parameters of saturated steam at certain depth, and they cannot be used to calculate other thermal parameters of underground saturated steam, and also cannot be used to determine the thermal condition of the underground saturated steam. In the U.S.A., GRC company adds a mercury thermometer (similar to a medical thermometer) which is 10 cm long and which maximum scale is 700 F to the lower part of the pressure measuring device to measure the temperature and pressure of underground steam. In this method, time-varying pressure at different depth can be measured, but the measured temperature is only a maximum temperature of the underground steam, and yet it is impossible to calculate other thermal parameters of underground saturated steam.

So the present invention proposes a new kind of temperature and pressure measuring system which can measure the time-varying temperature and pressure of underground saturated steam at different depth simultaneously. (i.e. two relation equation $P=f1(\tau)$, $t=f2(\tau)$, wherein P indicates pressure, t indicates temperature, and $\tau$ indicates time). Because the measured temperature and pressure of underground saturated steam are obtained at the same time, they are corresponded one by one, so these data can be used to calculate other thermal parameters of underground saturated steam correctly and determine an effective steam injection method.

The underground temperature and pressure measuring system for hot-exploiting oil well proposed by the present invention adopts a kind of structure in which the temperature sensing unit and its recording system is put around the pressure sensing unit and its recording system. In this method, not only the temperature and pressure at different depth can be measured simultaneously, but also the total length of the measuring device is not increased, so it is especially sitable to measure underground thermal conditions.

SUMMARY

The underground temperature and pressure measuring system for hot-exploiting oil well proposed by the present invention adopts a new structure in which the temperature sensing unit and its recording system is put around the pressure sensing unit and its recording system, and the temperature recording pen is put around the pressure recording pen. The pressure recording pen passes through the temperature recording pen, and their pen points situate on separate positions axially, so that the temperature and pressure can be recorded on single recording card. The temperature sensing unit and its recording system and the pressure sensing unit and its recording system are connected by means of bellows. The hollow shaft, transmission shaft and recording pen are righted by righting unit or righting slice with three flanges. The pressure sensing element is made of 3YC10 which consists of Ni: 40%–45%; Co: 10%–15%; Ti: 2%–5%; Al: 0.7%–1.0%; Nb: 1.0%–1.5%; C: 0.005%–0.05% and Fe, and which preferred component is Ni: 43%; Co: 12%; Ti: 3%; Al: 0.9%; Nb: 1.3%; C: 0.01% and Fe. The present invention also includes a time-controlling unit, a high-temperature sealing element and a casing of the device.

DETAILED DESCRIPTION OF THE INVENTION

Figure 1A:
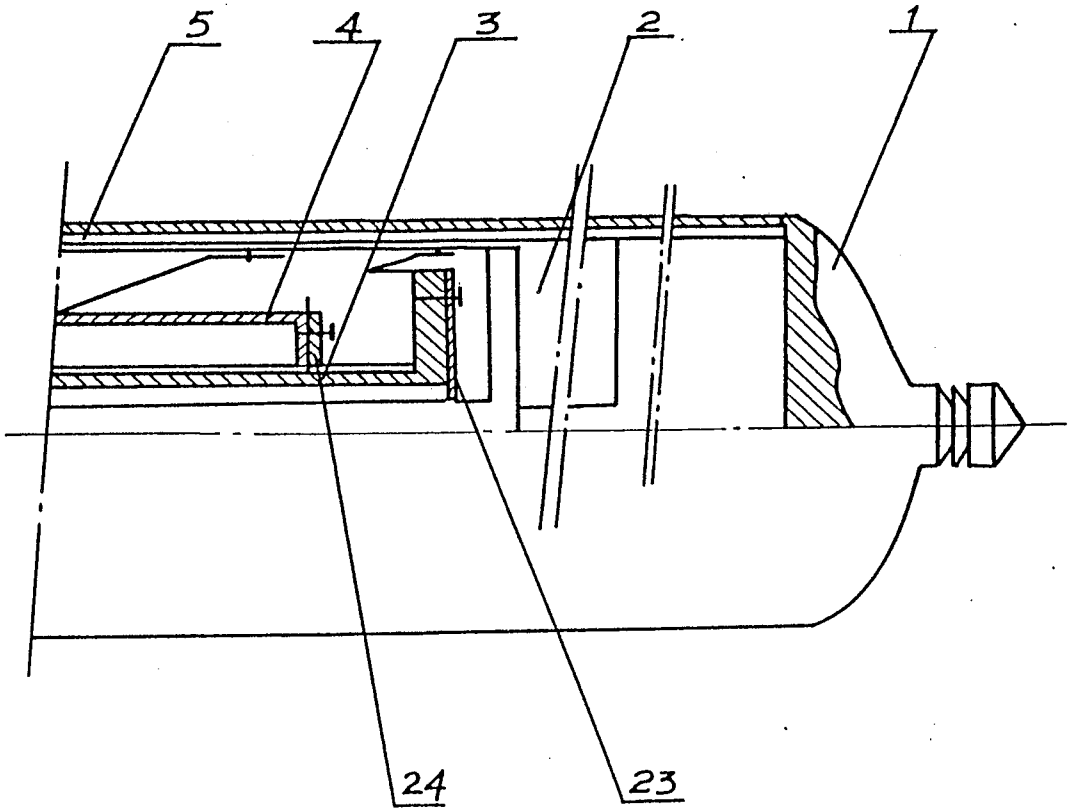

The casing of the underground temperature and pressure measuring system for hot-exploiting oil well proposed by the present invention is divided into three parts: upper part, middle part and lower part. A little hole is arranged on the lower part, which is used to make the measured saturated steam flow in. The upper part and the middle part are screwed together.

Said time-controlling unit uses a high-temperature clock to drive the stroke connecting rod fixed in the recording cylinder by means of clutch, screw and nut mechanism. When the high-temperature clock rotates, said connecting rod combined with the recording cylinder moves at uniform speed axially, and therefore, with the time passed, said recording cylinder moves at uniform speed axially. Said recording cylinder and recording cylinder backing are slippingly fitted each other and only move relatively in the axial direction, and the recording cylinder backing is fixed on the casing.

The lower part of the casing and the lower end of the middle part of the casing are all screwed on the lower connecting unit of the casing to make the lower part of the casing connect with the middle part of the casing. A solid cylinder which extends axially is arranged on the lower connecting unit. A high-temperature sealing element is fitted between the casing connecting unit and the casing.

Said pressure sensing unit and its recording system mainly includes a spiral pressure sensing element, a transmission shaft, a bellows A and a pressure recording pen. Said pressure sensing element is a spiral spring pipe made of precise constant elastic alloy 3YC10, which is evacuated to be vacuum and is fully filled with silicone oil and then is put around the solid cylinder of said lower connecting unit, and which is righted by said solid cylinder, one end (fixed end) of which is fixed on the lower connecting unit and other end (free end) of which is connected with the transmission shaft which is rotatably and centrically inserted the solid cylinder of said lower connecting unit. The upper end of said transmission shaft is connected with the pressure recording pen by means of bellows A. A righted slice for pressure recording pen is centrically fitted on the upper end of said pressure recording pen. A center hole is arranged on said righting slice, and three flanges which extend toward the center are arranged in the center hole. The center shaft of the recording cylinder which can only move axially passes through the center hole of said righting slice for pressure recording pen, and therefore the pressure recording pen is righted. High-pressure saturated steam enters the casing through the little hole on the lower end of said casing, and flows through the filter to act on the silicone oil in the opening of the fixed end of said pressure sensing element, so the pressure sensing element is acted by said pressure, and the free end of said pressure sensing element rotates the transmission shaft, and drive said pressure recording pen to rotate by means of said bellows A, and therefore the pressure recording pen records circular displacement of the pressure recording pen point which is caused by pressure changing on the recording card on the recording cylinder.

The temperature sensing unit and its recording system mainly includes a spiral temperature sensing element made of thermometal 5J25, which is put around the hollow shaft, and one end (free end) of which is connected with the lower end of said hollow shaft, and other end (fixed end) of which is connected with the righting unit A fixed on the casing. A center hole is arranged on the righting unit A, which is similar to that on the righting slice for pressure recording pen on shape. The hollow shaft passes through said center hole and is righted by it. A righting unit B is fitted on the bottom end of the hollow shaft, in which a center hole similar to that on the righting slice for pressure recording pen on shape is arranged. The transmission shaft passes through said hole, and therefore the lower end of the hollow shaft is righted by the righted transmission shaft, and the upper end of the hollow shaft is connected with the temperature recording pen by means of bellows B. A righting slice for temperature recording pen is arranged on the upper end of the temperature recording pen, on which a center hole similar to that on the righting slice for pressure recording pen on shape is arranged. Said righted pressure recording pen passes through said center hole, and therefore the temperature recording pen is righted.

While the pressure is being measured, the casing is heated by the saturated steam. When the heat is conducted to the temperature sensing element made of thermometal, the free end of said temperature sensing element will deform to cause circular motion, and drive the hollow shaft to rotate the temperature recording pen by means of bellows B, and therefore said temperature recording pen records the trace of the pen point on the recording card on the wall of the recording cylinder which moves axially.

In this method, two curves indicating time-varying temperature and pressure of measured saturated steam are recorded on the recording card respectively at the same time, which are the traces of circular motion of the recording pen points caused by the deformation of the sensing units. Because these curves only indicate the traces of the circular motion of the recording pen points, which are caused by the deformation of the pressure sensing unit and the temperature sensing unit at corresponding temperature and pressure, they must be calibrated by the standard card measured at the standard pressure and tempweature conditions on the ground level. Said standard card of the measuring system on the ground level is obtained by applying a standard pressure and temperature on the measuring system to cause the displacement of the pressure recording pen point and the temperature recording pen point, i.e. a rating equation for every measuring system is obtained by means of said rating equation for each measuring system such as P(pressure)$=aL+b$, t(temperature)$=a'L'+b'$ (wherein a, b, a', b' are constant which are different for each measuring system, L indicates the displacement of the pressure recording pen point, L' indicates the displacement of the temperature recording pen point), the underground measured card obtained by means of the present measuring system can be converted into time-varying pressure and temperature data by means of standard card measured on the ground level.

PREFERRED EMBODIMENT

The embodiment of underground temperature and pressure measuring system for hot-exploiting oil well proposed by the present invention is hereafter detailed referring to the drawings.

Figure 1B:
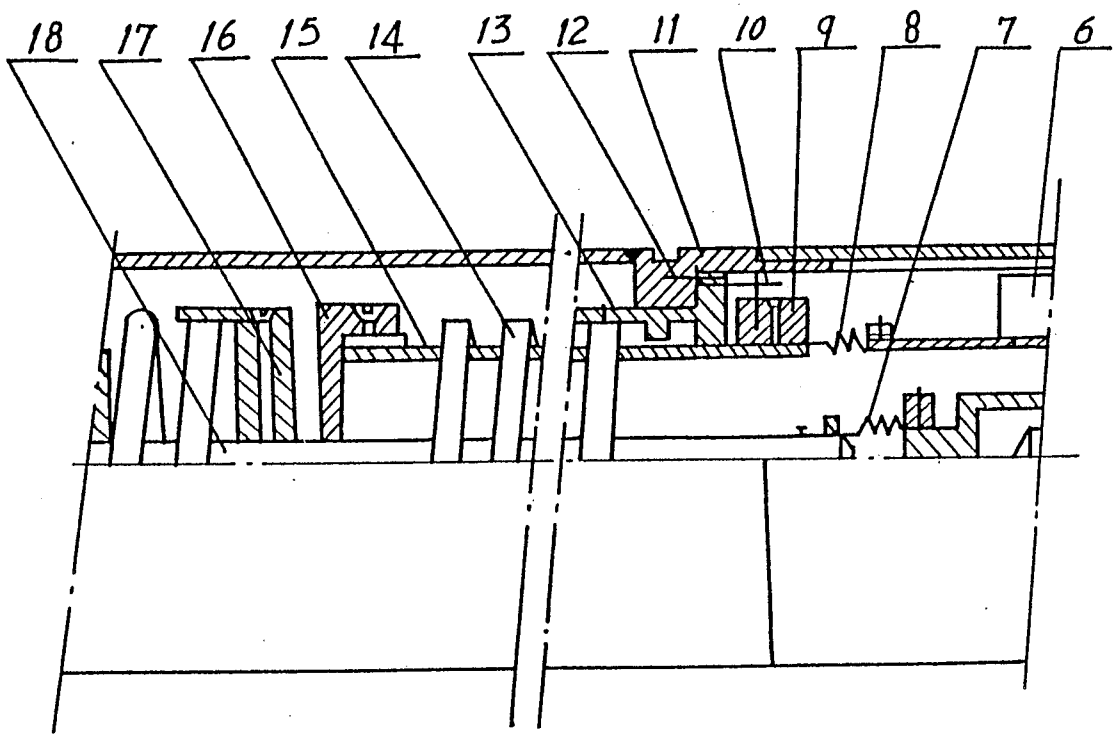
Figure 1C:
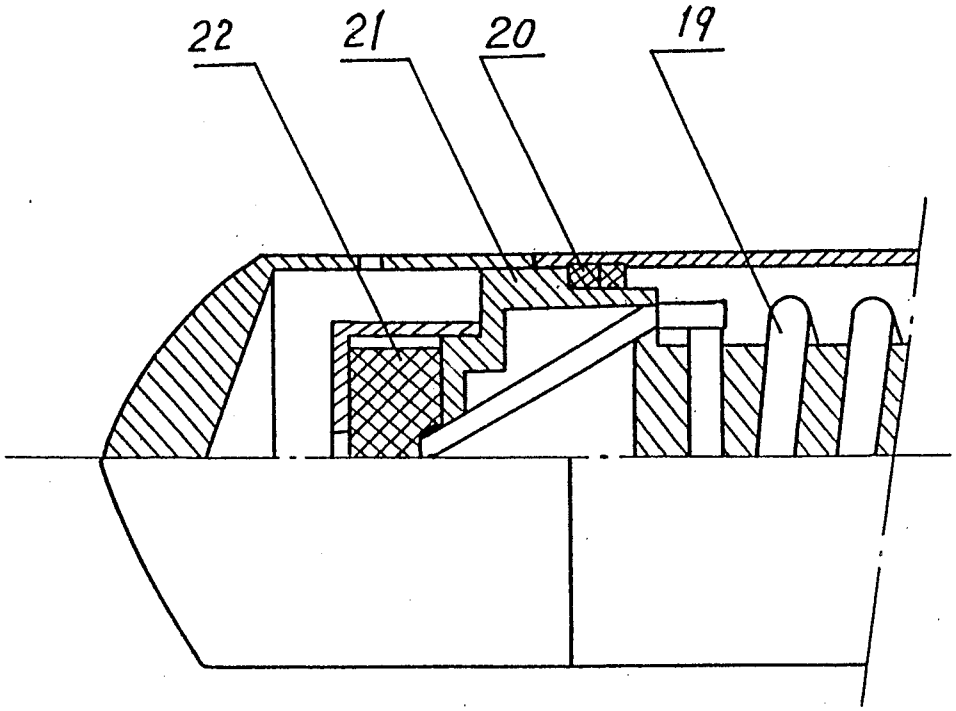
Figure 13:
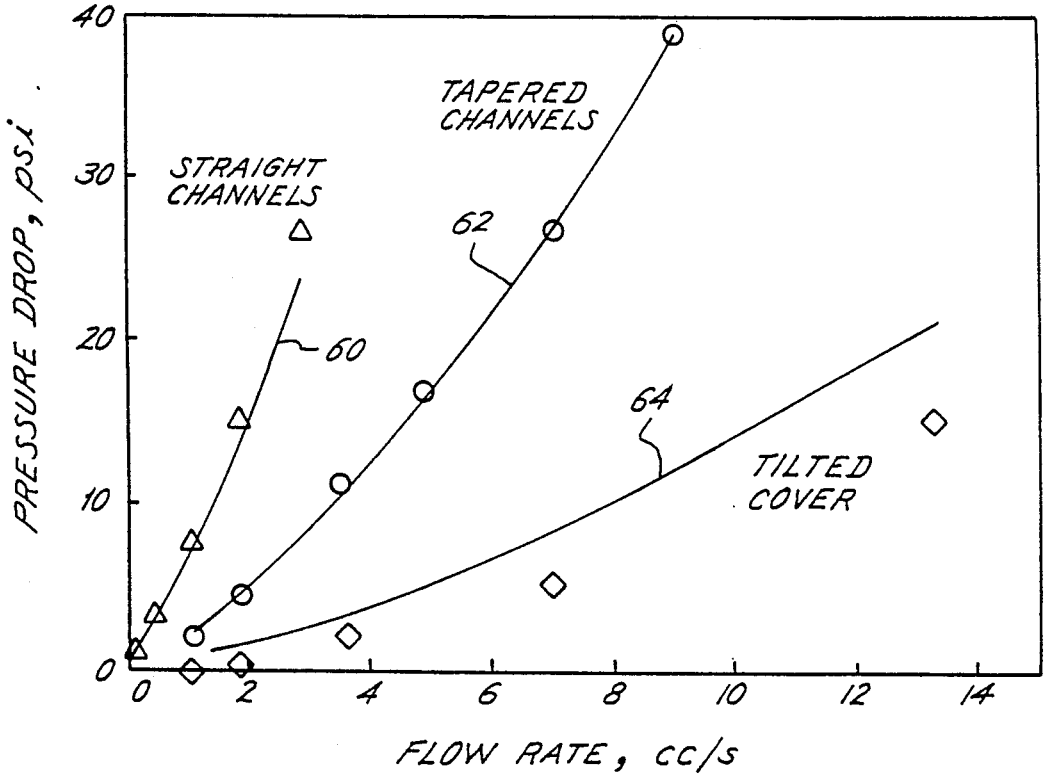

FIG. 1*a*, FIG. 1*b* and FIG. 1*c* are the structural schematic drawings of the upper part, the middle part and the lower part of the present measuring system, the combination of which indicates the relationship of every part of the system.

Figure 2:
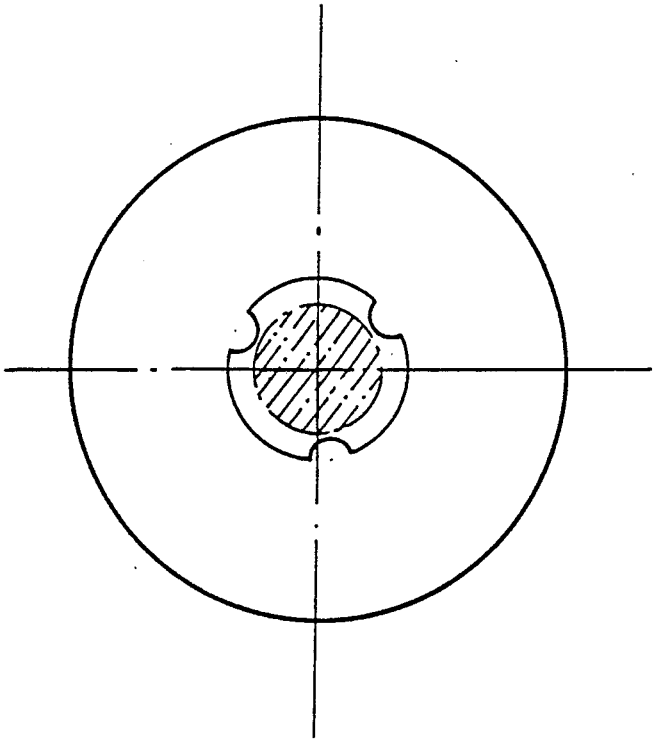

FIG. 2 is the enlarged schematic drawing of the center hole of the righting unit or righting slice.

The preferred embodiment of the present measuring system is the underground temperature and pressure measuring system for hot-exploiting oil well used on Huanxiling oil-exploiting zone, Liaohe oil field, which rating equation is $P=0.65L+0.5$ MPa, $t=7.8L'+60°$ C. (wherein P indicates pressure, t indicates temperature, L indicates the displacement of the pressure recording pen point, L' indicates the displacement of the temperature recording pen point).

The casing of said measuring system can be divided into three parts: upper part, middle part and lower part. A little hole is arranged on the lower end of the lower part, which is used to make the measured saturated steam flow in. The middle part and the lower part are screwed on the lower connecting unit 21 of the casing to make them connect together. A high-temperature sealing element is fitted between said lower connecting unit 21 and the casing 1. The upper part is screwed on the middle connecting unit 11 welded on the upper end of the middle part to make the upper part connect with the middle part.

A solid cylinder is formed on the upper end of the lower connecting unit 21 of the casing and a filter 22 is fixed on the lower end of the lower connecting unit 21 of the casing. A spiral pressure sensing element 19 is put around said solid cylinder, one end (fixed end) of which is connected with the lower connecting unit of the casing, and other end (free end) of which is fixed on a locking element 17 which is fixed on a transmission shaft 18, and said transmission shaft 18 is centrically and rotatably inserted in the said solid cylinder. The upper end of the transmission shaft 18 is connected with the pressure recording pen 3 by means of bellows A 7. A righting slice 23 is fixed on the upper end of said pressure recording pen, and the center shaft of the recording cylinder passes through the center hole of said righting slice, so as to right the upper end of the pressure recording pen. The hollow spiral pipe pressure sensing element is filled with silicone oil by means of evacuation-and-perfusion method. The measured saturated steam entered through the little hole on the lower end of the casing flows through the filter 22 and acts on the silicone oil in the opening of the fixed end of the spiral pipe pressure sensing element to cause the pressure sensing element to deform and make the free end rotate the transmission shaft 18, and also make the pressure recording pen rotate, so that the pen point records the displacement of the rotation on the recording card on the wall of the recording cylinder 6.

The spiral temperature sensing element 14 made of thermometal is put around the hollow shaft 15, one end (fixed end) of which is connected with the righting unit A 13 fixed on the middle connecting unit 11, and other end (free end) of which is connected with the lower end of the hollow shaft. A righting unit B 16 is fitted on the lower end of the hollow shaft, and righted transmission shaft 18 passes through the center hole of the righting unit B 16, and therefore the lower end of the hollow shaft 15 is righted. The upper end of the hollow shaft 15 is connected with the temperature recording pen 4 by means of bellows B 8. The series connected hollow shaft 15, bellows B 8 and temperature recording pen 4 is put around the series connected transmission shaft 18, bellows A 7 and pressure recording pen 3. A righting slice 24 for temperature recording pen is fitted on upper end of the temperature recording pen, and the pressure recording pen passes through the center hole of the righting slice 24, and therefore the upper end of the temperature recording pen is righted by the righted pressure recording pen. The hollow shaft passes through the center hole of the fixed righting unit A, so that its middle part is righted. A temperature rating unit 9 is fixed around the hollow shaft. By fitting the pin on the hollow shaft with the pin on the middle connecting unit 11, the primary deformation of the temperature sensing element 14 can be adjusted. When the heat from the measured steam is conducted to the temperature sensing element 14, the temperature sensing element made of thermometal will deform to rotate the hollow shaft by means of its fixed end, and also make the temperature recording pen 4 rotate by means of bellows B, and therefore the pen point records the displacement on the recording card on the same recording cylinder. Because the temperature recording pen 4 is put around the lower part of the pressure recording pen, the pressure recording pen point and the temperature recording pen point will record individual displacement on the same recording card simultaneously without inter-perturbance.

By means of screw and nut mechanism, the rotation motion of the high-temperature clock (not shown on drawings) is transformed into uniform speed axial motion of the recording cylinder, the pressure recording pen point and the temperature recording pen point record individual displacement which are related to the pressure and temperature of measured steam on the recording card on the wall of the recording cylinder 6.

What is the claim is:

1. A kind of underground temperature and pressure measuring system for hot-exploiting oil well comprising a casing; a time-controlling unit; a high-temperature sealing element fitted between a lower connecting unit and said casing; a pressure sensing unit and its recording system, wherein, a pressure sensing element in said pressure sensing unit is spiral pipe, one end (fixed end) of which is connected with the lower connecting unit of said casing, and other end (free end) of which is connected with a transmission shaft rotatably mounted on the lower connecting unit of said casing, and a pressure recording pen is fixed on said transmission shaft, and yet a temperature sensing unit and its recording system is put around the pressure sensing unit and its recording system, so that it is possible to measure temperature and pressure simultaneously, and a spiral temperature sensing element made of thermometal is put around the hollow shaft, one end (free end) of which is connected with a lower end of a hollow shaft, and other end (fixed end) of which is connected with righting unit A fixed on the casing; an upper end of said hollow shaft is connected with a temperature recording pen by means of bellows, the series connected hollow shaft, bellows B and temperature recording pen is put around the series connected transmission shaft, bellows A and pressure recording pen; a righting unit B is fixed on the lower end of the hollow shaft, and said transmission shaft passes through a center hole of said righting unit B, and therefore the lower end of said hollow shaft is righted by the lower end of said transmission shaft; a center hole is formed in the righting unit A fixed on the casing, through which the hollow shaft passes, and therefore the hollow shaft is righted by the casing; a righting slice for pressure recording pen is arranged on the upper end of the pressure recording pen, and a center shaft of the recording cylinder which is mounted on the casing movably in the axial direction passes through the center hole of said righting slice, so that the pressure recording pen is righted by the center shaft of the recording cylinder; a righting slice for temperature recording pen is arranged on an upper end of the temperature recording pen, and the pressure recording pen passes through the center hole of the righting slice for temperature recording pen, so that the upper end of the temperature recording pen is righted by the pressure recording pen which is righted by the center shaft of the recording cylinder; said time-controlling unit uses a high-temperature clock to drive the recording cylinder to move at uniform speed in an axial direction.

2. A kind of underground temperature and pressure measuring system for hot-exploiting oil well as claimed in claim 1, wherein, a similar center hole on shape is respectively formed in the righting slice for temperature recording pen, the righting slice for pressure recording pen, the righting unit A and the righting unit B, and three flanges which extend toward the center of said hole are arranged on each hole, and the top surface of said flanges is fitted with the exterior surface of the pressure recording pen, the center shaft of the recording cylinder, the hollow shaft and the transmission shaft respectively which pass through the corresponding center hole.

3. A kind of underground temperature and pressure measuring system for hot-exploiting oil well as claimed in claim 1 or 2, wherein, the pressure sensing element of said pressure sensing unit is a spiral spring pipe, which is made of a kind of precise constant-elastic material which consists of Ni: 40%–45%; Co: 10%–15%; Ti: 2%–5%; Al: 0.7%–1.0%; Nb: 1.0%–1.5%; C: 0.005%–0.05% and Fe, and said high-temperature sealing element is made of flexible grapgite.

* * * * *